US006119576A

United States Patent [19]

Isachsen

[11] Patent Number: 6,119,576

[45] Date of Patent: Sep. 19, 2000

[54] METHOD AND SYSTEM FOR AUTOMATIC DETERMINATION OF AMMUNITION TYPE, AND THE USE THEREOF

[76] Inventor: Øyvind Isachsen, Niels Juels gt. 38, N-0257 Oslo, Norway

[21] Appl. No.: 09/101,697

[22] PCT Filed: Jan. 15, 1997

[86] PCT No.: PCT/NO97/00012

§ 371 Date: Jul. 15, 1998

§ 102(e) Date: Jul. 15, 1998

[87] PCT Pub. No.: WO97/26502

PCT Pub. Date: Jul. 24, 1997

[30] Foreign Application Priority Data

Jan. 15, 1996 [NO] Norway ..... 960164

[51] Int. Cl.[7] ..... F41A 9/37

[52] U.S. Cl. ..... 89/45; 89/41.03

[58] Field of Search ..... 89/45, 46, 47, 89/41.03

[56] References Cited

U.S. PATENT DOCUMENTS

| | | | |
|---|---|---|---|
| 4,923,066 | 5/1990 | Ophir et al. | 209/538 |
| 5,157,486 | 10/1992 | Baird et al. | 358/101 |
| 5,177,318 | 1/1993 | Martinez et al. | 89/46 |
| 5,233,125 | 8/1993 | Bouver et al. | 89/47 |
| 5,341,720 | 8/1994 | Franzen et al. | 89/45 |

FOREIGN PATENT DOCUMENTS

| | | | |
|---|---|---|---|
| 39 43 206 | 7/1991 | Germany | 209/538 |
| 20949450 | 9/1982 | United Kingdom | 89/41.03 |

OTHER PUBLICATIONS

Popular Mechanics, Resupplying On The Attack, p. 18, Jun. 1996.

K. C. Pan, Application of Robots in Ammo Handling/Loading, Army Research Maga., pp. 15–17, Oct. 1983.

*Primary Examiner*—Stephen M. Johnson

*Attorney, Agent, or Firm*—Young & Thompson

[57] ABSTRACT

A method and a system for automatic identification of ammunition type simultaneously with the performance of loading is based on optical reading of the ammunition's silhouette, and emits a signal concerning ammunition type to a computer for calculation of parameters for firing of the ammunition or to a display panel which indicates the ballistic data for the ammunition. The system is specially, but not exclusively, intended for use in armored vehicles. The system may include a selector switch for selecting between AUTOMATIC and MANUAL modes. The method and the system may also be employed for automatic correction of firing data as a result of wear caused by the use of different ammunition types.

11 Claims, 4 Drawing Sheets

METHOD AND SYSTEM FOR AUTOMATIC DETERMINATION OF AMMUNITION TYPE, AND THE USE THEREOF

CROSS REFERENCE TO RELATED APPLICATION

This is the 35 USC 371 national stage of international application PCT/NO97/00012 filed on Jan. 15, 1997, which designated the United States of America.

FIELD OF THE INVENTION

The invention concerns a method and a system for automatic identification of ammunition type in connection with guns both with and without firing computers. The method and the system are particularly, but not exclusively, intended for firing shells from armoured vehicles. The invention also concerns an application of the system for calculation of firing data.

BACKGROUND OF THE INVENTION

Many types of ammunition are often used today, where the different ammunition types have different departure speeds and weights. The result of this is that the different ammunition types have differing ballistic characteristics. At present the ammunition type is normally manually fed by the person who loads the gun. As a rule this process is implemented by the person pressing a key or operating a switch on a control panel associated thereto. Ballistic data concerning the ammunition are then retrieved from the control panel, which data are either presented to the person who has to calculate the firing parameters or are transmitted directly to a firing computer which performs these calculations and controls the firing. When firing takes place with a gun employing this kind of manual feeding of ammunition type, it is a common occurrence for the person loading the gun and feeding in the ammunition type to place one type of ammunition in the gun and key in another type of ammunition or perhaps forget to key in the ammunition type. One result of this is that the target is not hit since the ballistic data which form the basis of the firing parameters, and the actual ballistic data for ammunition deviate from each other. This kind of faulty feeding in of information occurs relatively frequently, and up to 10% of the entries are assumed to be wrong. An example of a control panel currently in use is illustrated in FIG. 1.

U.S. Pat. No. 5,233,125 discloses a system for automatic loading, and comprises a device for identification of ammunition type and selection of the correct ballistic data which are transmitted to a computer for control of the firing. This identification device is based on the bar code principle, which implies that all ammunition must be provided with bar codes to enable the identification device to work. If bar codes are not applied to the ammunition which has to be used, an operator must manually feed in the necessary data concerning ammunition type. The device also requires the ammunition to be located in a specific position, and thus cannot be used independently of the automatic loading system.

U.S. Pat. No. 5,157,486 describes a camera sensor having an array of charge-coupled device (CCD) units that are used in connection with the real-time creation of a high resolution silhouette image of an object on a moving conveyor. The sensor is used in relation to automatic inspection or assembly of objects. The objects pass between a camera sensor and a light source after which they move downstream to a conventional detector and diverter which enables reorientation and/or rejection of improperly oriented or sized articles. The sensor is not meant for use in combination with a weapon firing system and is thus not adapted to this purpose.

SUMMARY OF THE INVENTION

The object of the present invention is therefore to avoid the drawbacks mentioned in connection with the purely manual feeding in of the ammunition type, as well as the flaws and defects of the system according to the above-mentioned U.S. patent. Further objects of the invention are to simplify the loader's tasks and reduce the time taken to prepare the gun for firing. Provided the gunner carries out his job correctly, in all probability the target will thereby always be hit.

The above-mentioned advantages and objects are achieved with a method and a system which are characterized by features which are presented in the claims. Further features and advantages are presented in the attached dependent claims.

BRIEF DESCRIPTION OF THE DRAWINGS

The invention will be explained in more detail in the form of an embodiment with reference to the attached figures, in which.

DETAILED DESCRIPTION OF THE INVENTION

Figure 1:
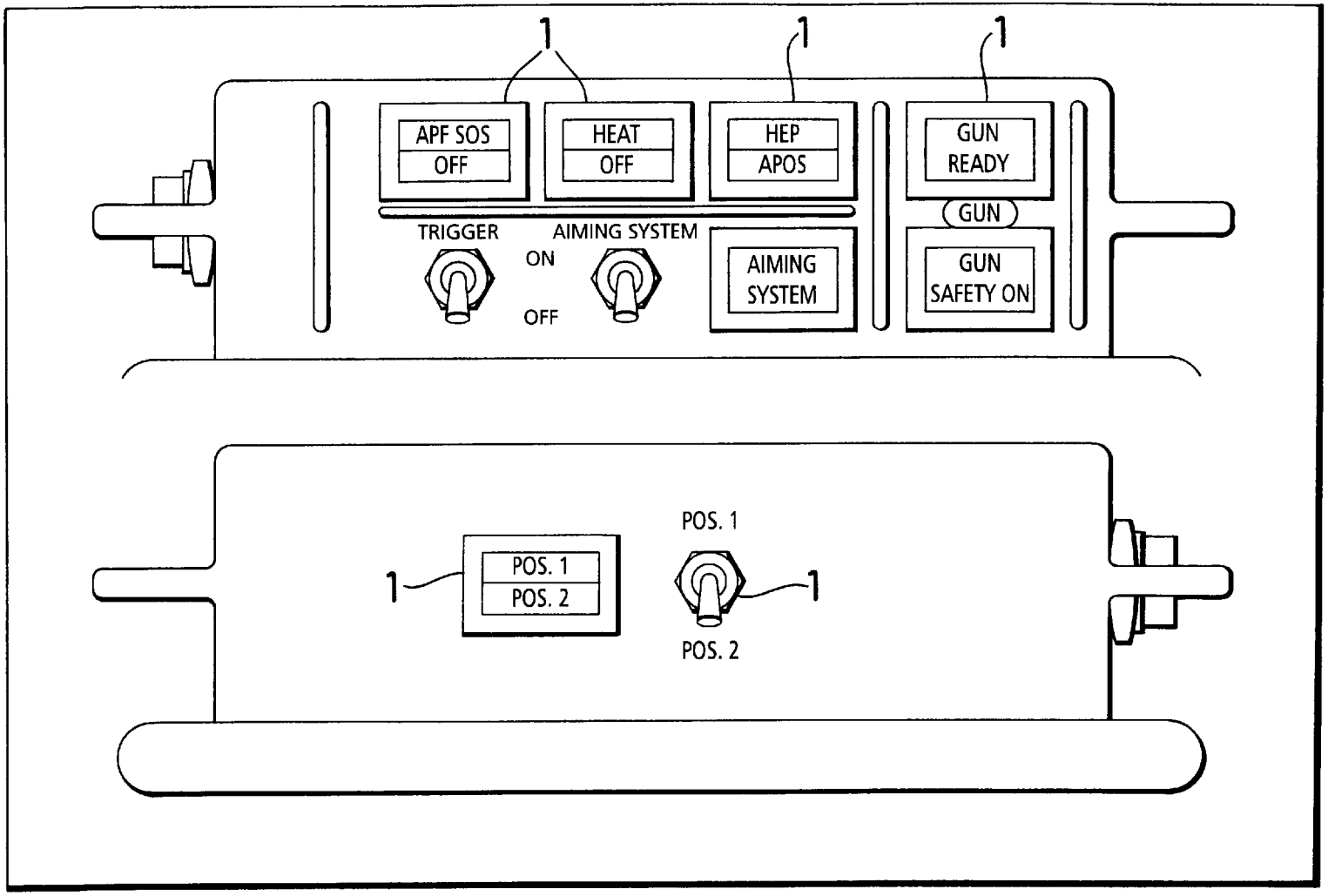
Fig.1 PRIOR ART
FIG. 1 illustrates a known control panel for manual feeding in of ammunition type.
Figure 2:
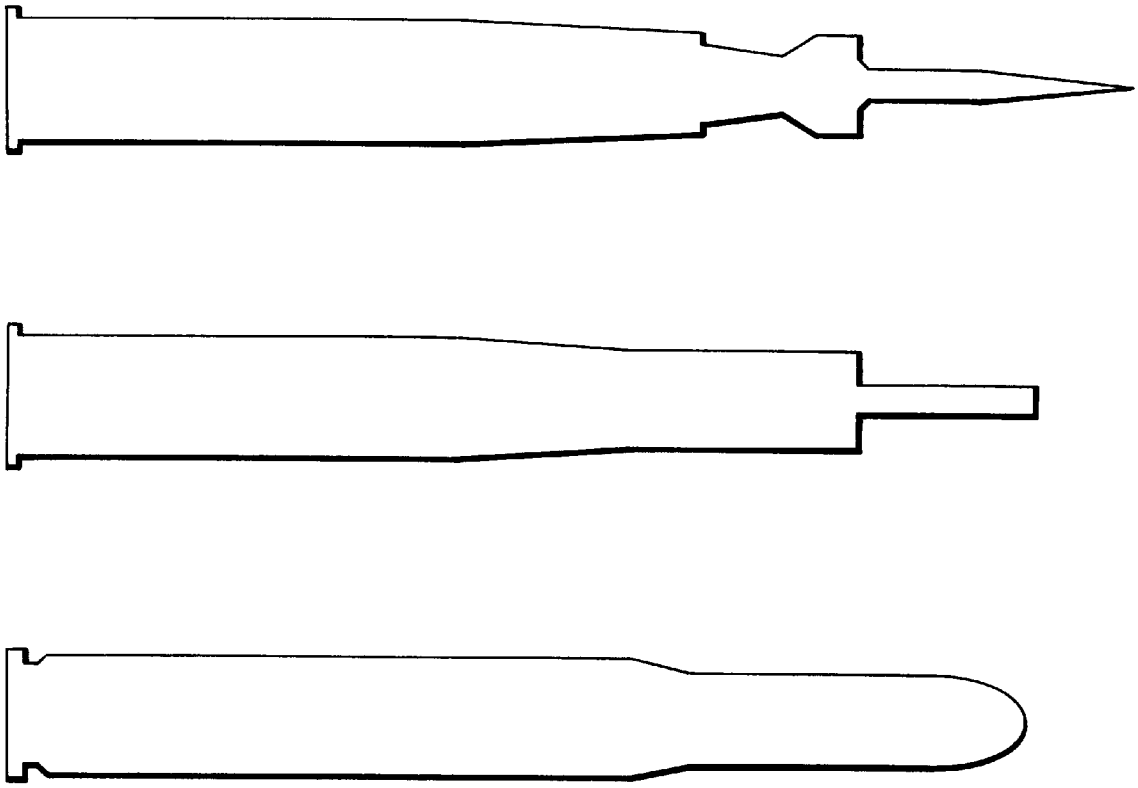
FIG. 2 illustrates silhouettes of some ammunition types currently in use.

In FIG. 1 the reference numeral 1 indicates the keys between which the loader must choose in order to specify the correct ammunition type, while reference numeral 20 designates the control panel which the loader has to operate before firing shots.

Figure 3:
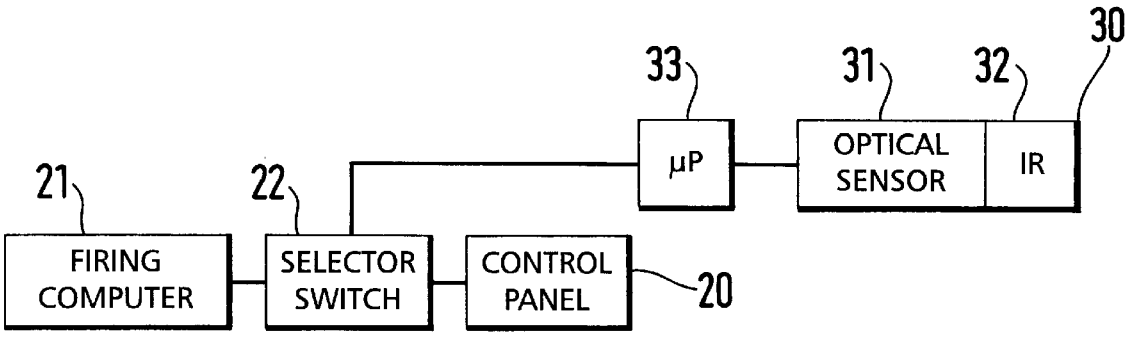
FIG. 3 is a principle drawing of a first embodiment of the invention.

FIG. 3 illustrates a linear sensor 31 for optical reading of the ammunition's silhouettes. The sensor is placed in the roof in the vicinity of the gun's breech block and is thereby not dependent on the ammunition being placed in a specific position. It is sufficient to pass the ammunition through a zone which extends over a relatively large area. It can also be envisaged that the ammunition is stationary while the sensor(s) are moved in relation to the ammunition, or that by means of, e.g., optical systems with movable mirrors or lenses, an apparent movement is created between ammunition and sensor.

The sensor may be of different types, one type being a sensor which performs a number of one-dimensional readings of the ammunition's contour (curtain sensor). When the readings are assembled a two-dimensional image of the contour will be obtained. Another type of sensor which can be employed is a video camera or, e.g., a CCD chip which takes one or more two-dimensional images of the ammunition. The use of such sensors enables the entire system to be stationary, with no relative movement being required between sensor and ammunition. In practice, more than one image will be employed to enable noise to be removed from the images by comparing several images taken at almost the same time. By means of devices in the microprocessor 33 the two-dimensional image(s) are analysed or the series of one-dimensional images from the first sensor type. The analysis determines the ammunition's silhouette, and on this basis it can be established what kind of ammunition is recorded by the sensor(s). Identification systems of this kind work rapidly and with great reliability. The ammunition type can thereby be determined with a high degree of accuracy by the microprocessor 33, despite interference in the form of, e.g., smoke or empty shell cases.

In connection with the sensor, the system can include an infrared radiation source 32. This source emits infrared radiation at least within the zone in which the sensor(s) perform the measurement(s). The infrared radiation source can either be mounted in the vicinity of the sensor 31 (not shown) or directly incorporated with the sensor 31 as illustrated in FIGS. 3 and 4.

The sensor 31 possibly with the infrared radiation source 32 together form a read unit 30, which together with the microprocessor 33 constitute an identification device. The reference numeral 20 designates the control panel from FIG. 1, while the reference numeral 21 designates the firing computer.

Figure 4:
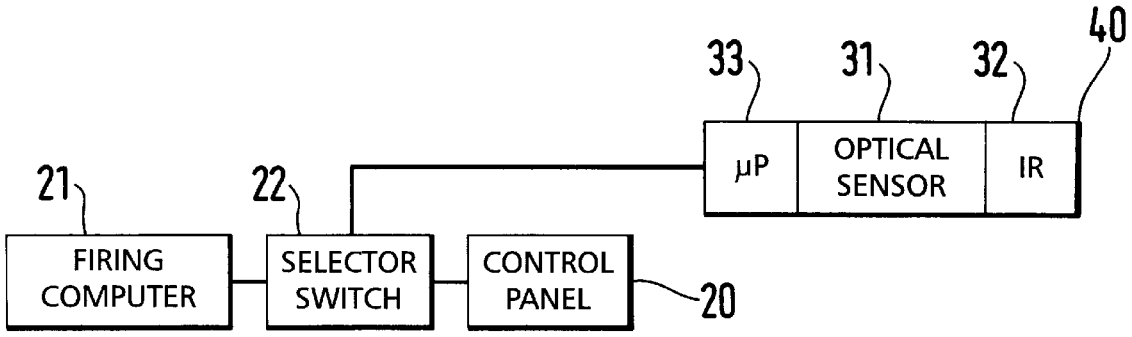
FIG. 4 is a principle drawing of a second embodiment of the invention.

In FIG. 4 the microprocessor 33 is incorporated with the sensor 31 and possibly the infrared radiation source 32 to form a complete identification device 40. The identification device according to one of the FIGS. 3 or 4 reduces the fault rate to 0.1%.

The signals from the microprocessor 33 are identical to the signals which are generated when the loader presses the correct key 1 on the control panel 20 in the known system for manual determination of ammunition type. By means of the present invention the possibility of error is avoided in connection with a manual specification of ammunition type. The firing computer 21 will thereby receive the correct ballistic data for calculation of the firing parameters when the identification device according to the invention is employed.

Between the control panel 20 and the firing computer 21 a selector switch 22 can be mounted for selecting between AUTOMATIC and MANUAL feeding of ammunition type. Even though the switch is positioned in AUTOMATIC mode, the functions which are not concerned with feeding of ammunition type will be connected to the firing computer. In a second variant (not shown in the figures) the selector switch can be built into the control panel, in which case the sensor(s) will be connected to this panel via the microprocessor which performs the actual analysis/identification of the ammunition and via the built-in selector switch.

Figure 5:
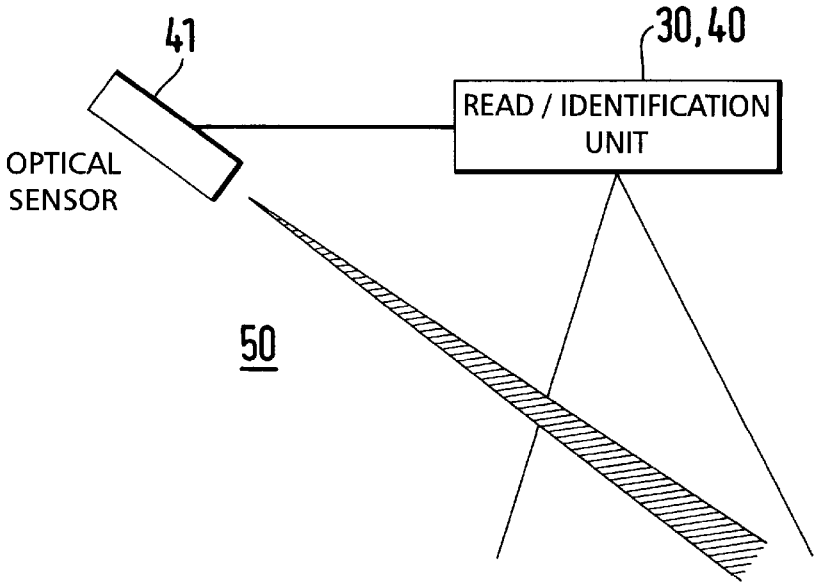
FIG. 5 is a principle drawing of a further development of the invention.

In the embodiment according to FIG. 5 the read unit 30 together with the microprocessor 33, or the identification device 40, are extended with an additional optical sensor 41, e.g. of the CCD type. This additional sensor is preferably equipped with its own microprocessor for processing the image from the actual sensor. The assembly is generally designated by reference numeral 50. This variant further reduces the fault rate in identification of ammunition type.

Figure 6:
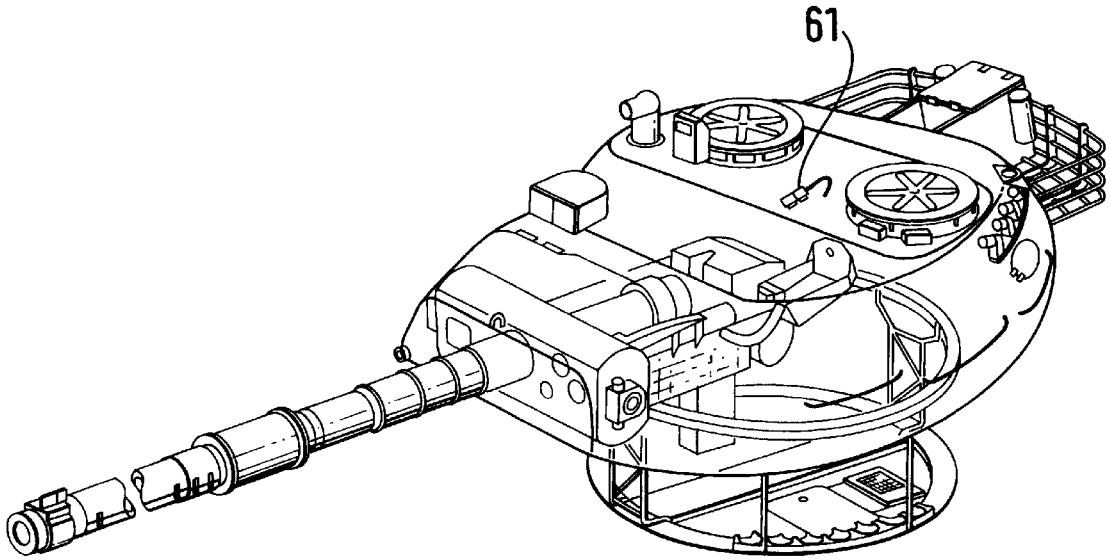
FIG. 6 illustrates the invention mounted inside the turret of an armoured vehicle.
Figure 7:
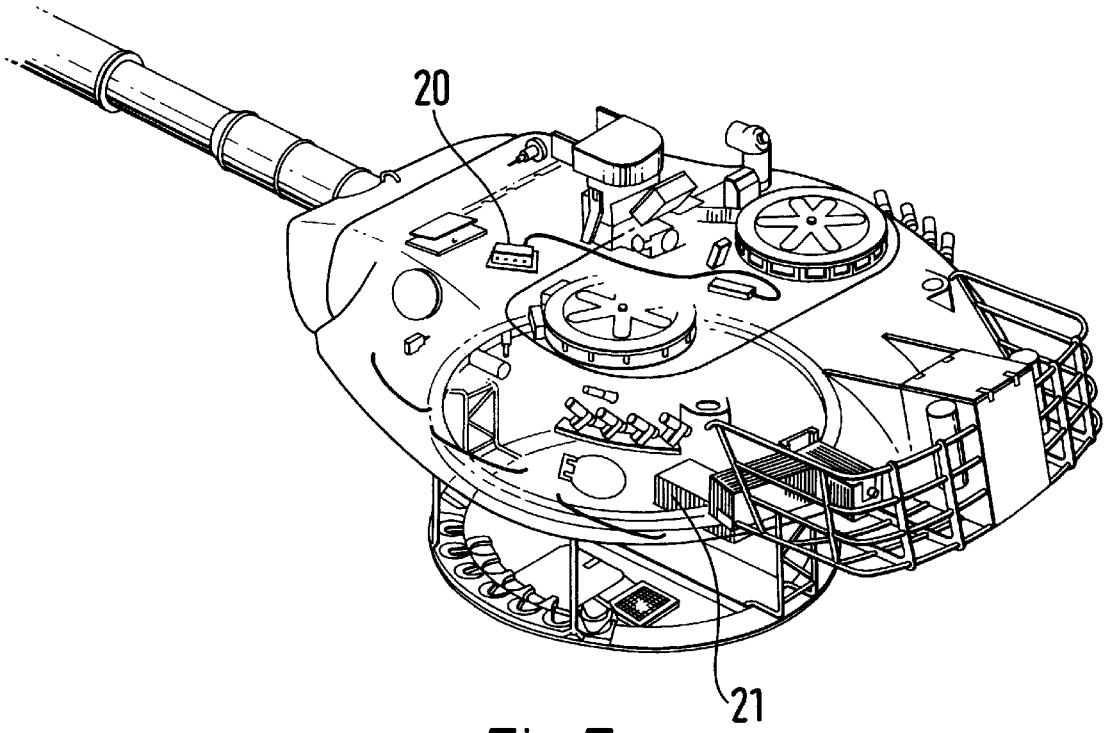
FIG. 7 illustrates the invention mounted inside the turret of an armoured vehicle viewed from another angle.

FIGS. 6 and 7 illustrate the system mounted in the turret of an armoured vehicle. Reference numeral 61 designates one of the devices 30, 40 or 50 together with the cable to the control panel. The reference numerals 20 and 21 are the same as before, referring to the control panel and firing computer respectively.

It is possible to connect a display panel to the identification system. e.g. if a firing computer is not used. When the identification system has identified the ammunition type, data concerning the ammunition type are employed to obtain ballistic data from a memory dedicated thereto. This memory may either be of a non-volatile or a volatile type.

The optical sensor(s) may be of other types than that specified above, e.g. the use may be envisaged of laser systems instead of the sensor types indicated. Other optical sensors may also be used, and as such lie within the scope of the invention. Many possibilities exist, the most important according to this invention being that it is not necessary to provide the ammunition with a special marking, e.g. in the form of bar codes, magnetic or electronic tags, etc.

It is also possible to incorporate several functions together with this system, e.g. the gun can be provided with an automatic safety device. This may be implemented, e.g. in such a manner that the system secures the gun for a predetermined period after the ammunition type has been established.

A special application of the system according to the invention is for automatically correcting the firing data for the tube wear resulting from the firing of a shot with a special ammunition type. Tube wear from the use of a specific ammunition type (HEAT-T M456 A1) for armoured vehicles is illustrated in table 1, which indicates the chances in tube diameter and muzzle velocity for a 105 mm gun, with consequent adjustment of the elevation for a given firing distance.

Other ammunition types give other wear values. When firing it will be necessary to correct the firing data for an existing tube wear which will be determined by the number of previously fired shots and ammunition types employed. When the ammunition type is recorded with the system according to the present invention and the shot fired, the tube wear for this shot can thereby be immediately specified and the firing data corrected for the next shot. When a firing computer is used the wear compensation can be performed entirely automatically in a particularly expedient fashion. This has obvious advantages when different ammunition types are used in turn. The standard conditions for wear correction for different ammunition types can then be stored in the firing computer's memory or in a memory connected with the microprocessor.

TABLE 1

HEAT-T M456 A1
1.6 NON-STANDARD CONDITIONS
CHANCE OF ELEVATION ANGLE AND
DEPARTURE SPEED AS A RESULT OF TUBE WEAR

| No. of standard shells | Tube dia. | | % change | Change of elevation angle | | | |
|---|---|---|---|---|---|---|---|
| left | mm | $V_0$ | of $V_0$ | 1000 m | 1500 m | 2000 m | 2500 m |
| 186 | 104,496 | 1180 | +0,511 | −0,042 | −0,070 | −0,106 | −0,152 |
| 171 | 104,750 | 1177 | +0,256 | −0,021 | −0,035 | −0,053 | −0,076 |
| 155 | 105,004 | 1174 | 0 | 4,322 | 7,137 | 10,557 | 14,778 |
| 139 | 105,258 | 1171 | −0,256 | +0,024 | +0,041 | +0,062 | +0,070 |
| 124 | 105,512 | 1168 | −0,511 | +0,048 | +0,081 | +0,124 | +0,180 |
| 109 | 105,766 | 1165 | −0,767 | +0,072 | +0,122 | +0,186 | +0,217 |
| 93 | 106,020 | 1162 | −1,022 | +0,096 | +0,162 | +0,247 | +0,361 |
| 78 | 106,274 | 1159 | −1,278 | +0,121 | +0,203 | +0,309 | +0,451 |

TABLE 1-continued

HEAT-T M456 A1
1.6 NON-STANDARD CONDITIONS
CHANCE OF ELEVATION ANGLE AND
DEPARTURE SPEED AS A RESULT OF TUBE WEAR

| No. of standard shells | Tube dia. | | % change | Change of elevation angle | | | |
|---|---|---|---|---|---|---|---|
| left | mm | $V_0$ | of $V_0$ | 1000 m | 1500 m | 2000 m | 2500 m |
| 62 | 106,528 | 1156 | −1,533 | +0,145 | +0,244 | +0,371 | +0,541 |
| 47 | 106,782 | 1153 | −1,789 | +0,169 | +0,284 | +0,433 | +0,632 |
| 31 | 107,036 | 1150 | −2,044 | +0,193 | +0,325 | +0,495 | +0,721 |
| 16 | 107,290 | 1147 | −2,300 | +0,217 | +0,366 | +0,557 | +0,812 |
| 0 | 107,544 | 1144 | −2,555 | +0,241 | +0,406 | +0,618 | +0,902 |

What is claimed is:

1. A method for automatic determination of a type of ammunition, substantially simultaneously with performing the loading of a weapon system having firing data fed to said weapon system either manually or automatically, the method comprising:

employing at least one optical sensor for registration of an object, said optical sensor being provided outside a normal area of movement during loading of the weapon system;

recording a silhouette of the ammunition;

utilizing the recording of the ammunition's silhouette to determine information relating to the type of ammunition; and feeding the information relating to the type of ammunition to at least one of a firing computer and a display unit in the weapon system.

2. The method according to claim 1, for automatically correcting firing data for tube wear, further comprising taking into account standard wear conditions for a recorded, employed and fired type of ammunition and a correction value existing before firing.

3. Apparatus for automatic determination of a type of ammunition, substantially simultaneously with performing the loading of a weapon system, the apparatus comprising:

at least one optical sensor for registration of an object, said optical sensor being structured and arranged to record a silhouette of the ammunition;

means for processing data related to the recorded silhouette for determining the type of ammunition; and means for feeding the type of ammunition to at least one of a firing computer and a display unit.

4. Apparatus according to claim 3, wherein the at least one optical sensor is a linear sensor which records a number of two-dimensional images.

5. Apparatus according to claim 3, wherein the at least one optical sensor is one of a video camera and a charge-coupled device unit.

6. Apparatus according to claim 3, further comprising an additional optical sensor, said additional optical sensor being one of a video camera and a charge-coupled device unit.

7. Apparatus according to claim 3, wherein said at least one optical sensor is connected to a microprocessor, and said microprocessor being free-standing or incorporated with the optical sensor.

8. Apparatus according to claim 7, wherein the microprocessor emits a predetermined signal which discloses the type of ammunition, and transmits said signal to the firing computer for calculating firing parameters of the ammunition on the basis of ballistic data of the ammunition.

9. Apparatus according to claim 7, wherein the microprocessor transmits a signal to the display unit for displaying ballistic data used in calculating parameters for firing of the ammunition.

10. Apparatus according to claim 3, further comprising an infrared radiation source for emitting infrared radiation within a measurement zone of the optical sensor, said infrared radiation source being located proximate to or incorporated with said optical sensor.

11. Apparatus according to claim 3, further comprising a selector switch for selecting between an automatic mode where the apparatus performs automatic identification of the type of ammunition based on the silhouette of the ammunition, or a manual mode where a person performs the loading and manually keys in the type of ammunition.

* * * * *